United States Patent [19]

Saunders

[11] 4,373,503

[45] Feb. 15, 1983

[54] SLINGSHOT WITH OUTER SLEEVE FOR ELASTIC BAND PROTECTION

[75] Inventor: Charles A. Saunders, Columbus, Nebr.

[73] Assignee: Saunders Archery Co., Columbus, Nebr.

[21] Appl. No.: 841,824

[22] Filed: Oct. 13, 1977

[51] Int. Cl.[3] ..... F41B 7/00

[52] U.S. Cl. ..... 124/20 R; 403/341; 403/286; 273/DIG. 6

[58] Field of Search ..... 124/20 R, 41 R, 16, 124/20 A; 156/51, 52; 174/21 R, 68 R; 339/116 R, 267 R; 128/346, 214; 403/341, 286; 24/243 R, 249 R

[56] References Cited

U.S. PATENT DOCUMENTS 2,716,982 9/1955 Ryan ..... 128/214.2
3,749,075 7/1973 Saunders ..... 124/20 R

FOREIGN PATENT DOCUMENTS 1186138 4/1970 United Kingdom ..... 339/116
1283175 7/1972 United Kingdom ..... 124/20 R

*Primary Examiner*—Richard C. Pinkham
*Assistant Examiner*—William R. Browne
*Attorney, Agent, or Firm*—Michael G. Berkman

[57] ABSTRACT

In a slingshot which includes a handle-supported yoke including a pair of laterally spaced rods to which missile-projecting elastic bands are attached, the improvement comprising a pair of flexible tube segments sleeved over the elastic bands in a zone of attachment of the bands to the rods. The elastic sleeves constitute bend resisting elements and obviate sharp reverse folding of the elastic bands which normally occurs upon recoil of the bands following distension and release of the stretched elastic bands in projecting a projectile.

4 Claims, 6 Drawing Figures

SLINGSHOT WITH OUTER SLEEVE FOR ELASTIC BAND PROTECTION

This invention relates to slingshots such as arm braced slingshots used for hunting and for target shooting. More particularly, the invention is directed to an improvement for extending the useful life of such slingshots, particularly the life of the elastic power bands which serve as the missile projecting means. Slingshots of the type in which the present invention finds utility are described in Saunders U.S. Pat. Nos. 3,511,221; 3,749,075; and 3,812,834, and the disclosures of those patents are incorporated herein by reference to the extent that they are not inconsistent herewith. The invention is useful with many other types of slingshots as well.

The problem of destructive, abrasive wear suffered by elastic power bands or tubes of slingshots upon release and subsequent foldover during recoil of the tubes after distension and release in use has been recognized in the art. This particular problem has been treated in the above-referred-to U.S. Pat. No. 3,749,075. In accordance with the invention there disclosed, the wear of the elastic bands was reduced by incorporating a probe-like spine as a coaxial projection extending from the ends of the rods to which the tubular elastic bands are secured. The spine constitutes in internal flexible support which resiliently restrains and limits the sharpness of bend of the elastic tubular members upon release and foldover. The internal spine has proved useful in practice and has resulted in markedly increased life for the tubular bands.

In accordance with the present invention it has been found that the useful life of the tubular elastic bands can be further extended, by a factor of two or more, by providing an external flexible and resilient support positioned as a sleeve encircling the elastic band in its zone of attachment to the slingshot rods and rearwardly thereof.

Another feature of the invention is an improved method for attaching the flexible probe-like spines at the ends of the hook elements to extend coaxially thereof and within the elastic power bands.

A related feature of the invention is an improvement in the structure of the elastic probes themselves.

Other and further objects, advantages, and features of the invention will be evident from a reading of the following specification considered in conjunction with the drawings in which.

The aims and objects of the invention are accomplished by providing, in a slingshot of the type in which resilient tubular power bands are secured to the hook-like ends of metal rods of the yoke of a slingshot, resilient and flexible sleeves which overlie the tubular bands in the zone of their attachment to the hook ends. It has been found that the improvement in the life of the power bands, correlated with the resilient mechanical restraint afforded by the sleeves, is significant, and much greater than expected.

Figure 1:
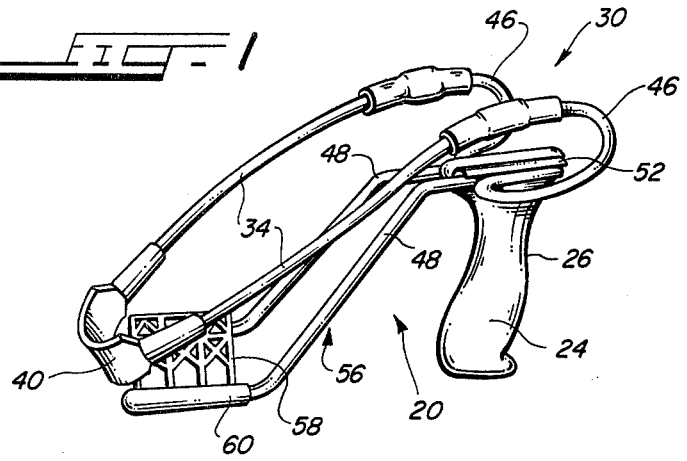
FIG. 1 is a perspective view of a slingshot embodying the protective sleeve of the invention.
Figure 2:
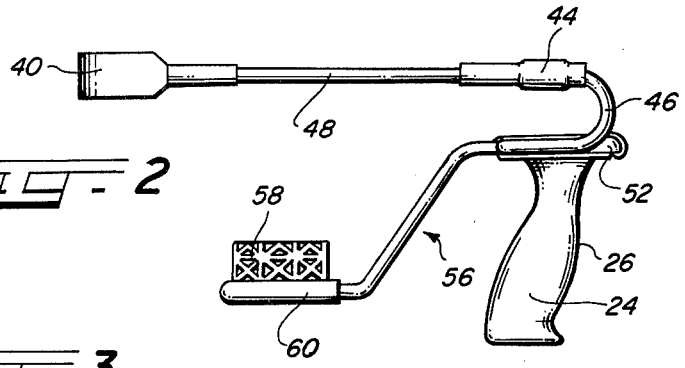
FIG. 2 is a side elevational view of the slingshot of FIG. 1.
Figure 3:
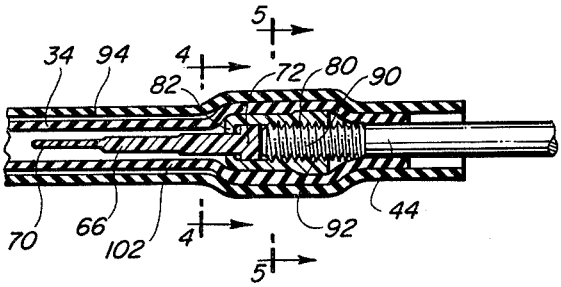
FIG. 3 is an enlarged cross sectional view taken substantially on the lines 3—3 of FIG. 2 and showing the manner of securement of the internal probes, the tubular power bands, and the protective sleeve in the zone of attachment of the bands to the ends of the hooks of the slingshot.
Figure 4:
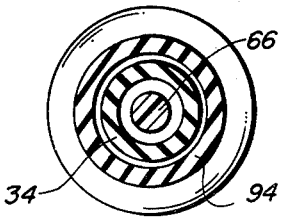
FIG. 4 is an enlarged cross-sectional view taken substantially on the lines 4—4 of FIG. 3.

While the improvement which constitutes the instant invention is generally applicable to many different types of slingshots, for the purpose of disclosure, the invention is described below with reference to a specific slingshot configuration. Referring now to the drawings, and particularly to FIGS. 1 and 3, the slingshot 20 depicted is shown as including a generally upright handle 24 conveniently contoured 26 to promote secure and comfortable hand gripping. A yoke or hook assembly 30 is fastened to the upper extremity of the handle 24, and a pair of elastic power bands 34 linked through a missile pouch 40 is connected to the free rearwardly directed ends 44 of reversely curved hooks 46 of the slingshot yoke 30. The yoke 30 itself includes a centrally disposed bight portion defining a pair of arms 48 adapted to seat within corresponding generally parallel, laterally-opening grooves 52 in the handle 26 to form a tight frictional engagement therewith. The handle 26 also carries an arm brace 56 which provides support against the forearm of the user when pulling force is applied to the elastic bands 34. A web-like strap 58 bridges the terminal sections 60 of the arm brace 56 for bearing on the forearm of the slingshot user. The particular form and structure and the manner of attachment of the slingshot yoke 30 and the arm brace 56 to the handle 26 constitute no part of the present invention. Accordingly, no exhaustive treatment is provided herein. A more complete description of a suitable arrangement is found in U.S. Pat. No. 3,812,834.

Figure 6:
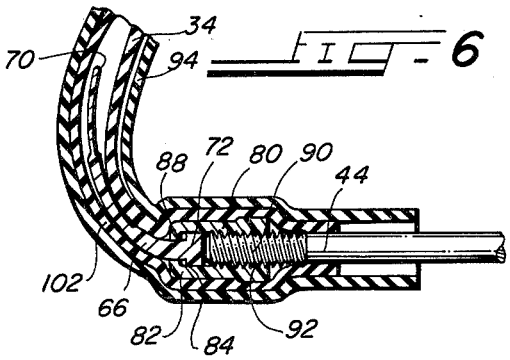
FIG. 6 is a cross-sectional view indicating schematically the manner in which the internal support probe and the external sleeve provide support and mechanical restraint to limit sharp foldover of the elastic power bands.
Figure 5:
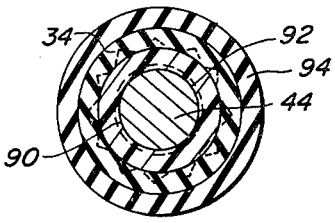
FIG. 5 is a cross-sectional view taken substantially on the lines 5—5 of FIG. 3.

The manner in which the elastic power bands 34 are secured to the ends 44 of the hooks 46, and the manner of attachment of the protective elements for limiting sharp overfold of the elastic bands is described with reference to FIGS. 3, 5, and 6. Proceeding from the interior of the structure outwardly, an elongated spine or spine-like probe 66 projecting rearwardly and coaxially of the rearwardly directed rod portions of the hook elements 46 is attached to the ends 44 thereof. The probe or spine 66, formed of a flexible material, tapers along the length thereof to define a bendable internal support exhibiting progressively decreasing cross sectional areas in a lineal direction from a point of securement to the hook elements to its rearwardly extending terminating tip 70. The forward end of the probe 66 is integrally formed with an annular flange 72. A cap 80 having an open socket sized for receiving the end 44 of the hook element 46 coaxially therewithin is integrally formed with a partial end wall 82 extending radially inwardly of and annularly about the cap 80 to provide a shoulder 84 defining a restricted opening 88 through which the probe 66 extends as the probe flange 72 abuts the cap shoulder 84. While the cap 80 may be secured to the end 44 of the rod 46 in any preferred manner, in the example of the invention shown, the end 44 of the rod 46 and the internal annular wall of the cap 80 are formed with mating threads 90 which, in conjunction with applied adhesive 92 constitute the means by which the probe or spine assembly is secured to the hook ends (FIGS. 3 and 5).

As shown in FIG. 3, the elastic tubular band 34 is positioned over the probe 66 and over the probe-securing cap 80, coaxially therewith and extends beyond the cap 80 frictionally to engage the rod 46 of the hook portion of the slingshot yoke. The internal spine, probe, or spine-like probe 66 provides internal support and resilient mechanical restraint to limit sharp overfold of the elastic band 34 upon recoil after distension of the bands in using the slingshot.

A critical feature of the present invention is the incorporation of an exterior support and restraining element about the power bands 34 along a lineal sector overlying a zone of attachment of the bands 34 to the hook elements 46. This exterior support is in addition to and augments the internal support. It serves a very important role in extending the useful life of the power bands.

As shown in FIG. 3, the external support element is a flexible tube, 94 preferably of rubber, which is sleeved over the elastic band 34 in contiguous and frictionally bonding contact with the band 34 in a lineal zone adjacent to the socket 80 capping the rod ends 44. The protective sleeve 94 extends rearwardly of the rod ends 44 to ensleeve and provide mechanical support for that portion of the band segment 102 rearwardly of the end 44 of the hooks 46. In the example of the invention illustrated, the sleeve 94 is dimensioned to provide an internal diameter slightly greater than an outer diameter of the power band 34, ensuring that the sleeve 94 will not impair the functioning of the power bands 34.

The above description is provided with reference to a preferred embodiment. It will be understood and appreciated by those skilled in the art that various modifications of the invention are possible and that such modifications may be made without departing from the spirit and scope of the invention as defined in the following claims.

What is claimed is:

1. In a slingshot including a generally upright handle, rod means for securing missile-projecting elastic band means to said handle, fastening means for attaching said rod means to said handle, elastic band means for projecting a projectile, said rod means terminating in hook elements having rearwardly directed free ends for attachment of said elastic band means thereto over each of said ends of said hook elements, the improvement comprising:

flexible and resilient tube means for protecting said elastic band means from fold-over fatigue and wear due to forward displacement of said band means and pivotal fold-over thereof about said ends of said hook elements upon elastic release and recoil of said band means in projecting a projectile, said tube means being sleeved over said elastic band means coaxially therewith along a lineal sector overlying a zone of attachment of said band means to said hook elements, said tube means being in contiguous, embracing contact with said elastic band means in said zone of attachment thereof to said hook elements and extending rearwardly of said ends of said hook elements, and said tube means being a flexible bend-limiting restraining element to obviate sharp reverse folding of said elastic band means upon distention and release of the stretched elastic band means in projecting a projectile.

2. A slingshot comprising:

a generally upright handle, rod means for securing missile-projecting elastic band means to said handle, fastening means for attaching said rod means to said handle, elastic band means for projecting a projectile, said elastic band means consisting essentially of tubing fabricated of high tensile strength, resilient, elastomeric material, said rod means terminating in hook elements having rearwardly directed free ends for attachment of said elastic band means thereto over each of said ends of said hook elements, probe means including an elongated, flexible and resilient spine, and means securing said probe means to extend coaxially of rearwardly-directed ends of said hook elements with said spine within said elastic band means to buffer, control, and to provide internal support and resilient mechanical restraint to limit sharp fold-over of said elastic band means upon recoil after distention and release of said elastic band means, said means for securing said probe means to said hook elements including caps having open-ended sockets sized for receiving and confining said ends of said hook elements coaxially therewithin, and means anchoring said caps on said ends of said hook elements, said caps being integrally formed with partial end wall means at ends of said caps opposed to the hook-end receiving opening thereof, said end wall means extending radially inwardly of and annularly about said caps to provide a shoulder defining a restricted opening in communication with the interior of said socket, and said probe means including radially enlarged end flange means at an end of said spine and disposed within said cap means forwardly of said end wall means with said flange means in abutment with said shoulder, and said spine projecting through said restricted opening and disposed interiorly of said tubing, means for protecting said elastic band means from fold-over fatigue related to forward recoil of said band means and pivotal fold-over thereof about said ends of said hook elements upon elastic release of said band means in projecting a projectile, said means for protecting said elastic band means comprising a flexible tube sleeved over said elastic band means coaxially therewith along a lineal sector overlying a zone of attachment of said band means to said hook elements, said tube being in contiguous contact with said elastic band means in said zone of attachment thereof to said hook elements and extending rearwardly of said ends of said hook elements, said tube constituting bend-resisting means to obviate sharp reverse folding of said elastic band means upon distention, release, and recoil of the stretched said elastic band means in projecting a projectile, and to protect said band means against extreme flexure during use of said slingshot.

3. The structure as set forth in claim 2 wherein said means for anchoring said caps on said ends of said hook elements comprise mating external threads on said ends and internal threads in said caps.

4. The structure as set forth in claim 2 wherein said spine is tapered along the length thereof to define a bendable support rod exhibiting progressively decreasing cross-sectional areas in a lineal direction from a point of securement thereof to said hook elements to a rearwardly extending tip of said spine.

* * * * *